US009187875B2

(12) United States Patent
Takahashi et al.

(10) Patent No.: US 9,187,875 B2
(45) Date of Patent: Nov. 17, 2015

(54) ARM FOR CONSTRUCTION MACHINE

(71) Applicant: HITACHI CONSTRUCTION MACHINERY CO., LTD., Tokyo (JP)

(72) Inventors: Takeshi Takahashi, Tsukuba (JP); Takayuki Shimodaira, Ryugasaki (JP); Ryuji Takada, Tsuchiura (JP); Makoto Sugaya, Narita (JP)

(73) Assignee: HITACHI CONSTRUCTION MACHINERY CO., LTD., Tokyo (JP)

( * ) Notice: Subject to any disclaimer, the term of this patent is extended or adjusted under 35 U.S.C. 154(b) by 0 days.

(21) Appl. No.: 14/362,421

(22) PCT Filed: Feb. 7, 2013

(86) PCT No.: PCT/JP2013/052858

§ 371 (c)(1),
(2) Date: Jun. 3, 2014

(87) PCT Pub. No.: WO2013/121969

PCT Pub. Date: Aug. 22, 2013

(65) Prior Publication Data

US 2014/0334906 A1 Nov. 13, 2014

(30) Foreign Application Priority Data

Feb. 16, 2012 (JP) ..... 2012-031534

(51) Int. Cl.
*E02F 3/38* (2006.01)
*E02F 9/00* (2006.01)

(52) U.S. Cl.
CPC .. *E02F 3/38* (2013.01); *E02F 9/006* (2013.01)

(58) Field of Classification Search
CPC ..... E02F 3/38
USPC ..... 414/722
See application file for complete search history.

(56) References Cited

U.S. PATENT DOCUMENTS

| | | | | |
|---|---|---|---|---|
| 2013/0343854 | A1 * | 12/2013 | Sugaya et al. | 414/727 |
| 2014/0010624 | A1 * | 1/2014 | Sugaya et al. | 414/727 |
| 2014/0056677 | A1 * | 2/2014 | Takahashi et al. | 414/727 |

FOREIGN PATENT DOCUMENTS

| | | | | | |
|---|---|---|---|---|---|
| JP | 09-242108 | A | | 9/1997 | |
| JP | 2001115477 | A | * | 4/2001 | E02F 3/38 |
| JP | 2001-271371 | A | | 10/2001 | |
| JP | 2005-029984 | A | | 2/2005 | |
| JP | 2005-213819 | A | | 8/2005 | |
| JP | 2005213819 | A | * | 8/2005 | E02F 3/38 |
| JP | 2009-062713 | A | | 3/2009 | |
| JP | 2009062713 | A | * | 3/2009 | |
| JP | 2009062714 | A | * | 3/2009 | |
| JP | 2009148808 | A | * | 7/2009 | |
| JP | 2010150775 | A | * | 7/2010 | |

* cited by examiner

*Primary Examiner* — Gerald McClain
(74) *Attorney, Agent, or Firm* — Mattingly & Malur, PC

(57) ABSTRACT

In an arm for a construction machine formed as a box-shaped structural body by left and right side plates, an upper plate, a lower plate, and a rear plate, a left rear thick side plate constituting the left side plate, a right rear thick side plate constituting the right side plate, a rear thick upper plate constituting the upper plate, and a rear thick lower plate constituting the lower plate are formed by using a soft steel material having a large plate thickness. A left front thin side plate constituting the left side plate, a right front thin side plate constituting the right side plate, a front thin upper plate constituting the upper plate, and a front thin lower plate constituting the lower plate are formed by using a high tensile steel material having a small plate thickness. As a result, the weight of the entire arm can be reduced.

7 Claims, 8 Drawing Sheets

ARM FOR CONSTRUCTION MACHINE

TECHNICAL FIELD

The present invention relates to an arm for a construction machine suitably used in a working mechanism mounted on a construction machine such as a hydraulic excavator and the like, for example.

BACKGROUND ART

In general, a hydraulic excavator which is a typical example of a construction machine is composed of an automotive lower traveling structure and an upper revolving structure rotatably mounted on the lower traveling structure. A working mechanism performing excavating work of earth and sand and the like is tiltably provided on the front side of a revolving frame constituting the upper revolving structure.

Here, the working mechanism of a hydraulic excavator is composed mainly of a boom having the base end side rotatably mounted on the revolving frame, an arm rotatably mounted on the distal end side of the boom, a working tool such as a bucket or the like rotatably mounted on the distal end side of the arm, and a boom cylinder, an arm cylinder, and a bucket cylinder driving the boom, the arm, and the bucket, respectively.

The arm constituting the working mechanism has a closed sectional structure having a square cross section and is formed as a lengthy box-shaped structural body whose whole length is as long as several meters. That is, the arm is formed of left and right side plates, an upper plate joined to the upper end sides of these left and right side plates by welding, a lower plate joined to the lower end sides of the left and right side plates by welding, and a rear plate joined to the rear end sides of the left and right side plates and the upper plate by welding as a box-shaped structural body having a closed sectional structure having a square cross section.

Here, a boom connecting boss is joined to the rear sides of the left and right side plates constituting the arm by welding, and a connecting pin rotatably connecting the boom and the arm to each other is inserted into the boom connecting boss. Moreover, an arm cylinder bracket is joined to the rear plate constituting the arm by welding, and a distal end side of the arm cylinder having a base end side mounted on the boom is connected to this arm cylinder bracket through the connecting pin.

As the left and right side plates, the upper plate, the lower plate, and the rear plate constituting the arm, a soft steel material, for example, a rolled steel material for a general structure such as SS400 and the like is usually used. By welding the left and right side plates, the upper plate, the lower plate, and the rear plate made of this soft steel material to each other, an arm made of a firm box-shaped structural body can be formed.

A boom in which the left and right side plates constituting the boom of a hydraulic excavator or the like are formed by joining three members (plate materials), that is, a first member, a second member, and a third member is proposed. In this boom, the second member located in a middle part in a length direction and easily subjected to buckling is formed by using a material with yield stress higher than those of the first and third members. As a result, a plate thickness of the second member can be made thinner than the first, second, and third members formed by using the same material, and weight reduction of the boom can be realized (Patent Document 1).

Therefore, when a high tensile steel material with larger tensile strength than the soft steel material is used as the left and right side plates, the upper plate, the lower plate, and the rear plate constituting the arm, a plate thickness of the left and right side plates, the upper plate, the lower plate, and the rear plate made of the high tensile steel material can be made smaller than the plate thickness of the left and right side plates, the upper plate, the lower plate, and the rear plate made of the soft steel material. Thus, the arm formed by using the steel plate made of the high tensile steel material can realize weight reduction while maintaining strength equal to the arm formed by using the steel plate made of the soft steel material.

PRIOR ART DOCUMENT

Patent Document

Patent Document 1: Japanese Patent Laid-Open No. 2009-62713 A

SUMMARY OF THE INVENTION

During an excavating work by the hydraulic excavator, the arm connected to the distal end side of the boom is rotated in accordance with an expansion/contraction operation of the arm cylinder. Thus, when the arm is to be rotated with respect to the boom, a large external force acts on a portion in the vicinity of the boom connecting boss provided on the rear side of the arm and the vicinity of the arm cylinder bracket.

Here, when the arm is formed by using the left side plate, right side plate, the upper plate, the lower plate, and the rear plate made of the soft steel material, and a large external force acts on this arm from the arm cylinder, since yield stress acting on each plate member located in the vicinity of the boom connecting boss and the arm cylinder bracket is low, residual stress remaining in a welded part between each plate member is low. Thus, even if a large external force acts from the arm cylinder, stress generated in the welded part between each plate member is relatively low.

On the other hand, when the arm is formed by using the left side plate, right side plate, the upper plate, the lower plate, and the rear plate made of the high tensile steel material, yield stress acting on each plate member located in the vicinity of the boom connecting boss and the arm cylinder bracket is high, and residual stress in the welded part between each plate member is high. Thus, if a large external force acts from the arm cylinder, the residual stress in the welded part is added to the large external force acting from the arm cylinder, and high stress is generated in the welded part between each plate member.

In this case, the arm has a closed sectional structure surrounded by the left and right side plates, the upper plate, and the lower plate. Thus, if the lower plate is welded to the lower end sides of the left and right side plates after the upper plate is welded to the upper end sides of the left and right side plates, for example, fillet welding can be applied from an outer side and an inner side of each of the side plates to corner parts where the upper plate intersects the left and right side plates. However, the fillet welding can be applied only from the outer side of each of the side plates to the corner parts where the lower plate intersects the left and right side plates. That is, the fillet welding cannot be applied from the inner side of each of the side plates. Thus, a non-welded part is formed on the inner sides of the corner parts where the inner sides of the left and right side plates and the lower plate intersect each other.

As described above, in the arm forming the closed sectional structure surrounded by the left and right side plates, the upper plate, and the lower plate, the non-welded part is formed on the inner side of the left and right side plates on any two of the corner parts in four corner parts in total, that is, two corner parts where the left and right side plates intersect the upper plate and two corner parts where the left and right side plates intersect the lower plate.

Therefore, when a large external force acts from the arm cylinder on the arm formed by using the left and right side plates, the upper plate, the lower plate, and the rear plate made of the high tensile steel material, stress concentrates on the non-welded parts formed on the inner side of each of the side plates in the plurality of corner parts where the left and right side plates intersect the upper plate and the lower plate. As a result, a fatigue crack can easily occur from this non-welded part, and there is a problem that fatigue strength of the arm deteriorates.

In view of the above-discussed problems with the conventional art, it is an object of the present invention to provide an arm for a construction machine configured so that weight of the entire arm formed by joining the left and right side plates, the upper plate, and the lower plate can be reduced and fatigue strength can be improved.

(1) The present invention is applied to an arm for a construction machine formed as a box-shaped structural body having a square cross section by a left side plate, a right side plate, an upper plate joined to upper end sides of the left and right side plates by welding, a lower plate joined to lower end sides of the left and right side plates by welding, and a rear plate joined to rear end sides of the left and right side plates and a rear end side of the upper plate by welding, in which a boom connecting boss located on rear part lower sides of the left and right side plates and joined to rear ends of the left and right side plates and the lower plate and a front end of the rear plate by welding is provided, and a pair of left and right arm cylinder brackets joined to an outer surface of the rear plate by welding are provided.

A characteristic of a configuration adopted by the present invention is that the left side plate is formed by joining two members, that is, a left rear thick side plate located on a rear side where the boom connecting boss is joined and made of a soft steel material with a large plate thickness and a left front thin side plate located on a front side of the left rear thick side plate and made of a high tensile steel material with a small plate thickness; the right side plate is formed by joining two members, that is, a right rear thick side plate located on the rear side where the boom connecting boss is joined and made of a soft steel material with a large plate thickness and a right front thin side plate located on the front side of the right rear thick side plate and made of a high tensile steel material with a small plate thickness; the upper plate is formed by joining two members, that is, a rear thick upper plate located on the rear side where the rear plate is joined and made of a soft steel material having a large plate thickness and a front thin upper plate located on the front side of the rear thick upper plate and made of a high tensile steel material having a small plate thickness; the lower plate is formed by joining two members, that is, a rear thick lower plate located on the rear side where the boom connecting boss is joined and made of a soft steel material having a large plate thickness and a front thin lower plate located on the front side of the rear thick lower plate and made of a high tensile steel material having a small plate thickness; and the rear plate is formed by using a soft steel material having a large plate thickness.

With this arrangement, the left rear thick side plate, the right rear thick side plate, the rear thick upper plate, and the rear thick lower plate are formed by a soft steel material having a large plate thickness, and the left front thin side plate, the right front thin side plate, the front thin upper plate, and the front thin lower plate are formed by a high tensile steel material having a small plate thickness, and thus, the weight of the entire arm can be reduced as compared with the case in which the arm is formed by using the left side plate, the right side plate, the upper plate, and the lower plate made of a single soft steel material, for example.

On the other hand, the boom connecting boss can be joined to the left rear thick side plate, the right rear thick side plate, and the rear thick lower plate made of a soft steel material, and the rear plate to which the arm cylinder bracket is to be joined can be joined to the left rear thick side plate, the right rear thick side plate, and the rear thick upper plate made of a soft steel material. Thus, by joining the left rear thick side plate, the right rear thick side plate, the rear thick upper plate, the rear thick lower plate, and the rear plate to each other, even if a non-welded part is formed on the inner side of the corner parts where each of these plates intersect each other, when an external force acts on the arm through the boom connecting boss and the arm cylinder bracket, since the left rear thick side plate, the right rear thick side plate, the rear thick upper plate, the rear thick lower plate, and the rear plate made of a soft steel material have low yield stress, appropriate deflection can be generated.

As a result, concentration of stress on the non-welded part formed on the inner side of the corner part where each of the plates intersects each other can be suppressed, and fatigue strength of the arm can be improved. As a result, weight reduction of the arm and improvement of fatigue strength of the arm can be both realized, and reliability of the entire arm can be improved.

(2) According to the present invention, it is configured such that the left rear thick side plate and the left front thin side plate are joined by a both-side welding bead formed by both-side welding from both surfaces of an outer surface and an inner surface; the right rear thick sideplate and the right front thin side plate are joined by a both-side welding bead formed by both-side welding from both surfaces of the outer surface and the inner surface; the rear thick upper plate and the front thin upper plate are joined by a both-side welding bead formed by both-side welding from both surfaces of the outer surface and the inner surface; and the rear thick lower plate and the front thin lower plate are joined by a both-side welding bead formed by both-side welding from both surfaces of the outer surface and the inner surface.

With this arrangement, formation of a non-welded part on a joint part between the left and right rear thick side plates and the left and right front thin side plates is suppressed, and the firm left side plate composed of the left rear thick side plate and the left front thin side plate and the firm right side plate composed of the right rear thick side plate and the right front thin side plate can be formed. Moreover, formation of a non-welded part on a joint part between the rear thick upper plate and the front thin upper plate is suppressed, and the firm upper plate composed of the rear thick upper plate and the front thin upper plate can be formed. In addition, formation of a non-welded part on a joint portion between the rear thick lower plate and the front thin lower plate can be suppressed, and the firm lower plate composed of the rear thick lower plate and the front thin lower plate can be formed. As a result, strength of the entire arm composed of the box-shaped structural body surrounded by the left and right side plates, the upper plate, the lower plate, and the rear plate can be further improved.

(3) According to the present invention, it is configured such that the boom connecting boss is composed of a cylindrical boss part penetrating the left and right side plates and extending in the left-right direction and through which a connecting pin for connecting the boom is inserted and left and right flange parts provided on both end sides in the left-right direction of the cylindrical boss part, respectively; boss fitting grooves fitted with the left and right flange parts of the boom connecting boss are provided on the left and right rear thick side plates, respectively; backing materials are provided on inner surfaces of the left and right rear thick side plates and the left and right flange parts of the boom connecting boss along a boundary portion between the flange parts and the boss fitting grooves, respectively; and the left and right rear thick side plates and the left and right flange parts of the boom connecting boss are joined by a one-side welding bead formed by one-side welding from the outer surface in a state in which the backing materials are brought into contact with the inner surface, respectively.

With this arrangement, by bringing the backing materials into contact with the inner surfaces of the left and right rear thick side plates and the left and right flange parts of the boom connecting boss, one-side welding can be applied from the outer surfaces between the left and right rear thick side plates and the left and right flange parts of the boom connecting boss. As a result, workability when the boom connecting boss is to be welded to the left and right side plates can be improved.

(4) According to the present invention, an upper end side of the left side plate composed of the left rear thick side plate and the left front thin side plate and the upper plate composed of the rear thick upper plate and the front thin upper plate are joined by a welding bead in which an outer bead part and an inner bead part formed by fillet welding from the both surfaces of the outer surfaces and the inner surfaces thereof are integrated; an upper end side of the right side plate composed of the right rear thick side plate and the right front thin side plate and the upper plate composed of the rear thick upper plate and the front thin upper plate are joined by a welding bead in which an outer bead part and an inner bead part formed by fillet welding from both surfaces of the outer surfaces and the inner surfaces thereof are integrated; a lower end side of the left side plate composed of the left rear thick side plate and the left front thin side plate and the lower plate composed of the rear thick lower plate and the front thin lower plate are joined by a welding bead formed by fillet welding from the outer surfaces thereof; and a lower end side of the right side plate composed of the right rear thick side plate and the right front thin side plate and the lower plate composed of the rear thick lower plate and the front thin lower plate are joined by a welding bead formed by fillet welding from the outer surfaces thereof.

With this arrangement, the left side plate and the upper plate can be firmly joined by the welding bead in which the outer bead part and the inner bead part are integrated, and the right side plate and the upper plate can be firmly joined by the welding bead in which the outer bead part and the inner bead part are integrated. On the other hand, the left sideplate and the lower plate can be firmly joined by the welding bead formed on the outer surface of the left side plate and the right side plate and the lower plate can be firmly joined by the welding bead formed on the outer surface of the right side plate.

(5) According to the present invention, a bucket connecting boss is joined by welding to distal ends of the left and right front thin side plates constituting the left and right side plates, the front thin upper plate constituting the upper plate and the front thin lower plate constituting the lower plate; a link connecting boss is joined adjacent to a rear side of the bucket connecting boss by welding to front sides of the left and right front thin side plates constituting the left and right side plates; and a pair of left and right bucket cylinder brackets are joined by welding on the outer surface of the rear thick upper plate constituting the upper plate.

(6) According to the present invention, the soft steel material is a low carbon steel material having a carbon content of less than 0.3%, and the high tensile steel material is a steel material having enhanced strength than the soft steel and having tensile strength of 50 kgf/mm$^2$ or more.

MODE FOR CARRYING OUT THE INVENTION

Figure 1:
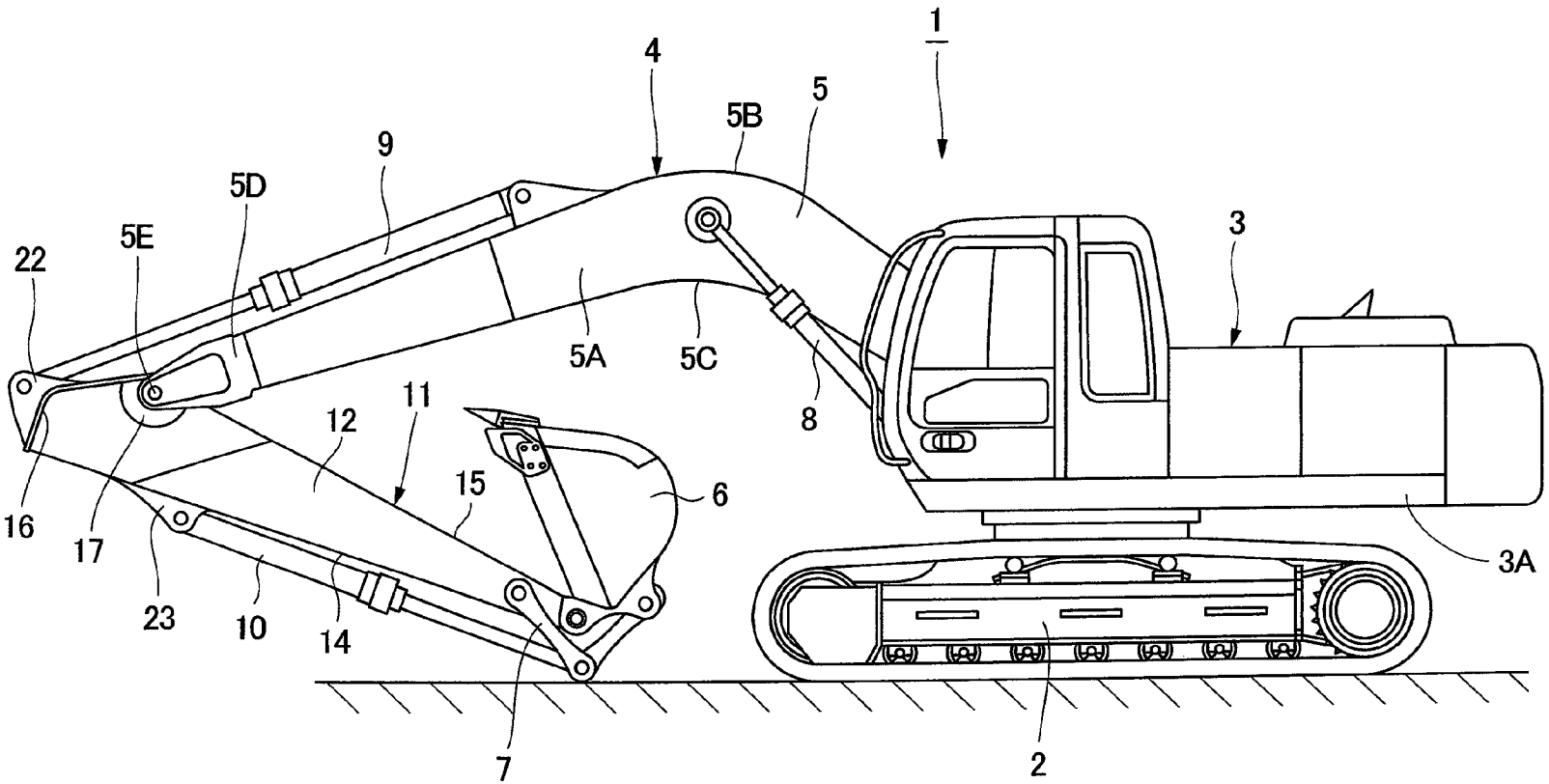
FIG. 1 is a front view showing a hydraulic excavator as a construction machine provided with an arm according to the present invention.

An embodiment of an arm for a construction machine according to the present invention will be described below in detail using a case in which it is applied to an arm of a hydraulic excavator as an example and by referring to the attached drawings.

Designated at 1 is a hydraulic excavator as a typical example of a construction machine in the figure. The hydraulic excavator 1 is constituted by an automotive crawler-type lower traveling structure 2, an upper revolving structure 3 rotatably mounted on the lower traveling structure 2, and a working mechanism 4 tiltably provided on a front side of a revolving frame 3A which becomes a base of the upper revolving structure 3.

The working mechanism 4 is provided with a boom 5 having a base end portion tiltably pin-connected to the front side of the revolving frame 3A, an arm 11 which will be described later and has a base end portion rotatably pin-connected to a distal end portion of the boom 5, a bucket 6 rotatably pin-connected to a distal end portion of the arm 11, and a bucket link 7 provided between the distal end side of the arm 11 and the bucket 6. In addition, the working mechanism 4 is provided with a boom cylinder 8 for moving the boom 5 upward/downward with respect to the revolving frame 3A, an arm cylinder 9 for rotating the arm 11 with respect to the boom 5, and a bucket cylinder 10 for rotating the bucket 6 with respect to the arm 11.

Here, the boom 5 is formed by joining left and right side plates 5A (only a left side is shown), an upper plate 5B, and a lower plate 5C to each other by welding. The boom 5 is formed as a box-shaped structural body having a square closed sectional shape, and a center part in a length direction is bent having a mountain shape. A bifurcated bracket 5D is provided at a front end side of the boom 5, and by connecting this bracket 5D and a boom connecting boss 17 of the arm 11, which will be described later, to each other through a connecting pin 5E, the arm 11 is rotatably supported on the tip end side of the boom 5. The left and right side plates 5A, the upper plate 5B, and the lower plate 5C constituting the boom 5 are formed by using a soft steel material having a large plate thickness, that is, a rolled steel material for a general structure such as SS400 and the like, for example, and on upper end portions of the left and right side plates 5A, the upper plate 5B is joined by fillet welding, while on lower end portions of the left and right side plates 5A, the lower plate 5C is joined by fillet welding.

In this case, since the boom 5 is a box-shaped structural body having a square closed sectional shape, a non-welded part might be formed on the inner side (the inner side of the boom 5) of two corner parts in four corner parts where the left and right side plates 5A, the upper plate 5B, and the lower plate 5C intersect each other. However, if an external force acts on the boom 5, appropriate deflection is generated in the left and right side plates 5A, the upper plate 5B, and the lower plate 5C made of a soft steel material, and concentration of stress on the non-welded part formed on the inner side of the corner parts where each of these plates intersect can be suppressed. As a result, the boom 5 can maintain sufficient fatigue strength even if the non-welded part is formed inside the corner parts where the left and right side plates 5A, the upper plate 5B, and the lower plate 5C intersect.

Subsequently, the arm according to this embodiment will be described by referring to FIGS. 2 to 12.

Designated at 11 is the arm rotatably mounted on the distal end portion of the boom 5. This arm 11 is formed as a lengthy box-shaped structural body extending in the front-rear direction as a whole and is rotated in the upward and downward directions by the arm cylinder 9 with respect to the boom 5.

Here, the arm 11 is formed of left and right side plates 12 and 13, an upper plate 14, a lower plate 15, and a rear plate 16 which will be described later, and the arm 11 has a box-shaped structural body having a closed sectional structure with a square section as a whole. A boom connecting boss 17, an arm cylinder bracket 22, and a bucket cylinder bracket 23 which will be described later are provided on the rear side (boom 5 side) of the arm 11. On the other hand, a bucket connecting boss 20, and a link connecting boss 21 which will be described later are provided on the front side (bucket 6 side) of the arm 11.

Figure 2:
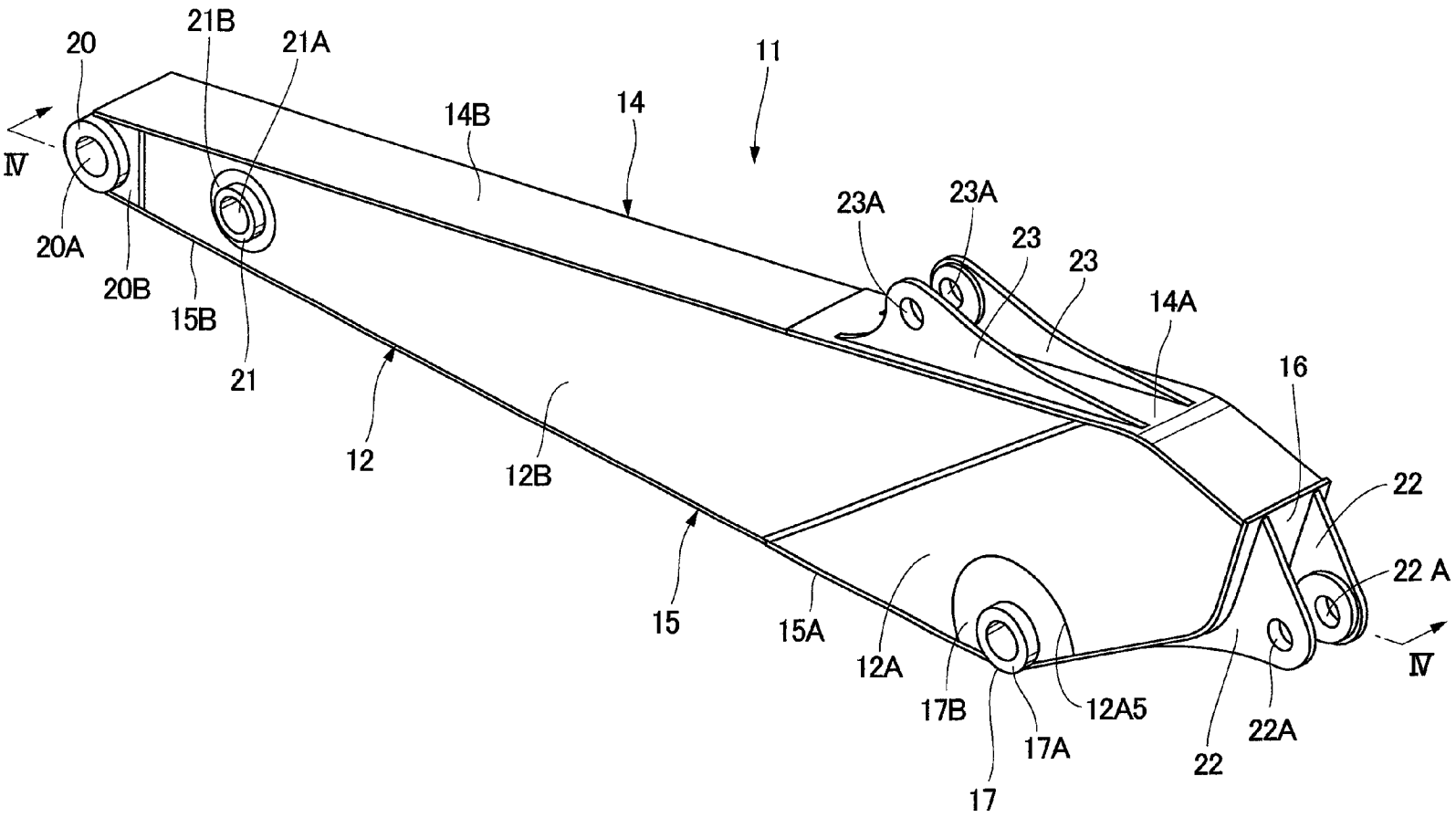
FIG. 2 is a perspective view showing the arm as a single body.
Figure 3:
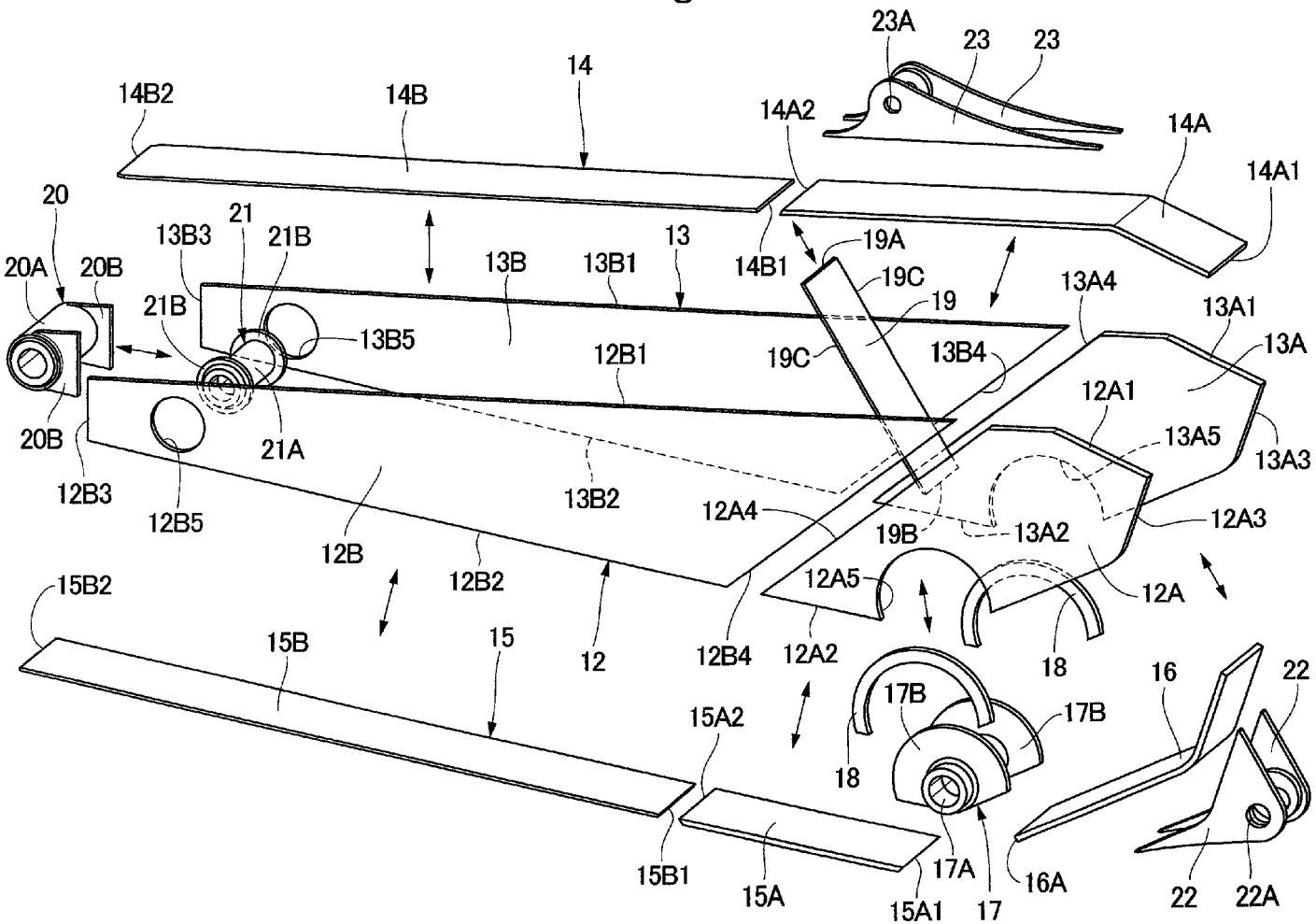
FIG. 3 is an exploded perspective view showing left and right side plates, an upper plate, a lower plate, a rear plate, a boom connecting boss, an arm cylinder bracket and the like constituting the arm in an exploded manner.

Indicated at 12 is a left side plate constituting a left side surface of the arm 11. This left side plate 12 extends in the front-rear direction while facing a right side plate 13 which will be described later in the left-right direction. Here, as shown in FIGS. 2 and 3, the left side plate 12 is formed by joining two members, that is, a left rear thick side plate 12A located on the rear side in the front-rear direction and a left front thin side plate 12B located on the front side in the front-rear direction. The boom connecting boss 17 which will be described later is joined to the left rear thick side plate 12A, and the bucket connecting boss 20, and the link connecting boss 21 which will be described later are joined to the left front thin side plate 12B.

The left rear thick side plate 12A is formed by using a soft steel material having a large plate thickness, that is, a rolled steel material for a general structure such as SS400 and the like, for example. Here, the soft steel material refers to a low carbon steel material having a carbon content of 0.1% or more and less than 0.3%, for example, and is widely used as a steel material for welding. The left rear thick side plate 12A has a hexagonal shape surrounded by an upper plate abutting portion 12A1, a lower plate abutting portion 12A2, a rear plate abutting portion 12A3, and a front thin side plate abutting portion 12A4. In this case, the front thin side plate abutting portion 12A4 extends diagonally forward toward the lower plate abutting portion 12A2 from the upper plate abutting portion 12A1 so as to ensure a length of the joint part between the left rear thick side plate 12A and the left front thin side plate 12B large. Moreover, a boss fitting groove 12A5 notched having an arc shape is provided at the corner part where the lower plate abutting portion 12A2 and the rear plate abutting portion 12A3 intersect each other, and a flange part 17B of the boom connecting boss 17 is fitted in the boss fitting groove 12A5.

On the other hand, the left front thin side plate 12B is formed by using a high tensile steel material having a plate thickness smaller than the left rear thick side plate 12A, namely by using a high tensile steel material such as SM570 and the like, for example. Here, the high tensile steel material refers to a steel material having enhanced strength by heat treatment, addition of an alloying element and the like to the soft steel and having tensile strength of 50 kgf/mm$^2$ (491 N/mm$^2$) or more and is widely used as a steel material for welding. The left front thin side plate 12B has a square shape surrounded by an upper plate abutting portion 12B1, a lower plate abutting portion 12B2, a bucket connecting boss abutting portion 12B3, and a rear thick side plate abutting portion 12B4. In this case, the rear thick sideplate abutting portion 12B4 extends diagonally forward from the upper plate abutting portion 12B1 toward the lower plate abutting portion 12B2. A circular boss fitting hole 12B5 is provided on a front end side of the left front thin side plate 12B, and a flange part 21B of the rear link connecting boss 21 is fitted in the boss fitting hole 12B5.

In a state in which the front thin side plate abutting portion 12A4 of the left rear thick side plate 12A and the rear thick side plate abutting portion 12B4 of the left front thin side plate 12B abut against each other, both-side welding is applied from both surfaces of outer surfaces and inner surfaces of the front thin side plate abutting portion 12A4 and the rear thick side plate abutting portion 12B4. As a result, the left side plate 12 in which two members, that is, the left rear thick side plate 12A and the left front thin side plate 12B are firmly joined by a both-side welding bead 12C without a non-welded part is formed.

Figure 6:
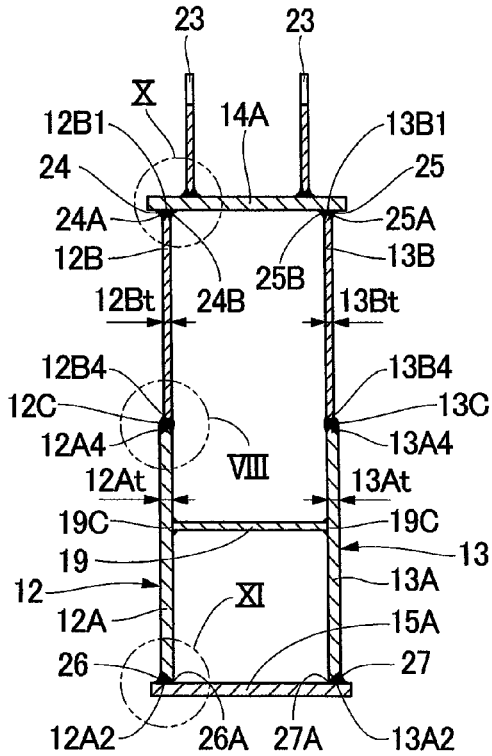
FIG. 6 is a sectional view of the left and right side plates, the rear thick upper plate, the rear thick lower plate and the like when seen from an arrow VI-VI direction in FIG. 5.

In this case, as shown in FIG. 6, a plate thickness 12Bt of the left front thin side plate 12B formed by using a high tensile steel material is set smaller than a plate thickness 12At of the left rear thick side plate 12A formed by using a soft steel material (12Bt<12At). As a result, the weight of the left side plate 12 can be reduced as compared with the case in which the left side plate is formed by using only the soft steel material.

Subsequently, indicated at 13 is a right side plate constituting a right side surface of the arm 11, and the right side plate 13 has the same shape as that of the left side plate 12. That is, the right side plate 13 is formed by joining two members, that is, a right rear thick side plate 13A located on the rear side in the front-rear direction and a right front thin side plate 13B located on the front side in the front-rear direction. The boom connecting boss 17 which will be described later is joined to the right rear thick side plate 13A, while the bucket connecting boss 20 and the rear link connecting boss 21 which will be described later are joined to the right front thin side plate 13B.

The right rear thick side plate 13A is formed by using a soft steel material having a large plate thickness and has a hexagonal shape surrounded by an upper plate abutting portion 13A1, a lower plate abutting portion 13A2, a rear plate abutting portion 13A3, and a front thin side plate abutting portion 13A4. At a corner part where the lower plate abutting portion 13A2 and the rear plate abutting portion 13A3 intersect each other, a boss fitting groove 13A5 notched having an arc shape is provided.

On the other hand, the right front thin side plate 13B is formed by using a high tensile steel material having a plate thickness smaller than that of the right rear thick side plate 13A and has a square shape surrounded by an upper plate abutting portion 13B1, a lower plate abutting portion 13B2, a bucket connecting boss abutting portion 13B3, and a rear thick side plate abutting portion 13B4. A circular boss fitting hole 13B5 is provided on the front end side of the right front thin side plate 13B.

In a state in which the front thin side plate abutting portion 13A4 of the right rear thick side plate 13A and the rear thick side plate abutting portion 13B4 of the right front thin side plate 13B abut against each other, both-side welding is applied from both surfaces of outer surfaces and inner surfaces of the front thin side plate abutting portion 13A4 and the rear thick side plate abutting portion 13B4. As a result, the right side plate 13 in which two members, that is, the right rear thick side plate 13A and the right front thin side plate 13B are firmly joined by a both-side welding bead 13C without a non-welded part is formed.

In this case, a plate thickness 13Bt of the right front thin side plate 13B formed by using a high tensile steel material is set smaller than a plate thickness 13At of the right rear thick side plate 13A formed by using a soft steel material (13Bt<13At). As a result, the weight of the right side plate 13 can be reduced as compared with the case in which the right side plate is formed by using only the soft steel material.

Subsequently, indicated at 14 is an upper plate constituting an upper surface of the arm 11. This upper plate 14 is joined to the upper end sides of the left and right side plates 12 and 13 and extends in the front-rear direction. Here, the upper plate 14 is formed by joining two members, that is, a rear thick upper plate 14A located on the rear side of the front-rear direction and a front thin upper plate 14B located on the front side of the front-rear direction. The bucket cylinder bracket 23 which will be described later is joined to the rear thick upper plate 14A.

The rear thick upper plate 14A is formed having a rectangular plate shape extending in the front-rear direction by using a soft steel material having a large plate thickness, that is, a rolled steel material for a general structure such as SS400 and the like, for example. The rear thick upper plate 14A has a part on the rear side of the bucket cylinder bracket 23 bent diagonally downward. A rear end edge of the rear thick upper plate 14A becomes a rear plate abutting portion 14A1 to be joined to the rear plate 16 which will be described later, and a front end edge of the rear thick upper plate 14A becomes a front thin upper plate abutting portion 14A2 to be joined to the front thin upper plate 14B.

On the other hand, the front thin upper plate 14B is formed having a rectangular plate shape extending in the front-rear direction by using a high tensile steel material having a plate thickness smaller than the rear thick upper plate 14A, that is, a high tensile steel material such as SM570 and the like, for example. A rear end edge of the front thin upper plate 14B becomes a rear thick upper plate abutting portion 14B1, and a front end edge of the front thin upper plate 143 becomes a bucket connecting boss abutting portion 14B2. The bucket connecting boss 20 which will be described later is joined to this bucket connecting boss abutting portion 14B2.

In a state in which the front thin upper plate abutting portion 14A2 of the rear thick upper plate 14A and the rear thick upper plate abutting portion 14B1 of the front thin upper plate 14B abut against each other, both-side welding is applied from both surfaces of outer surfaces and inner surfaces of the front thin upper plate abutting portion 14A2 and the rear thick upper plate abutting portion 14B1. As a result, the upper plate 14 in which two members, that is, the rear thick upper plate 14A and the front thin upper plate 14B are firmly joined by a both-side welding bead 14C without a non-welded part is formed.

Figure 5:
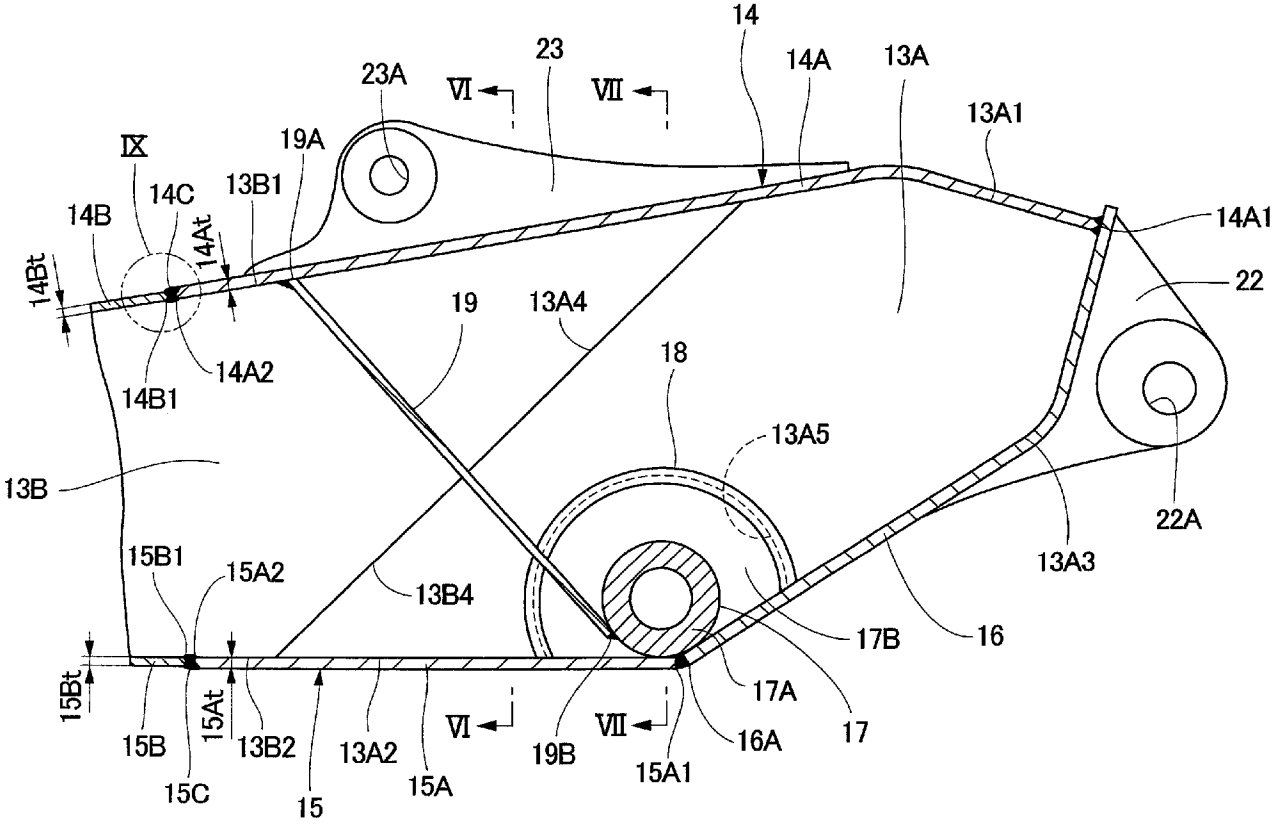
FIG. 5 is an enlarged sectional view showing a rear thick upper plate, a front thin upper plate, a rear thick lower plate, a front thin lower plate, the rear plate and the like in FIG. 4.

In this case, as shown in FIG. 5, a plate thickness 14Bt of the front thin upper plate 14B formed by using a high tensile steel material is set smaller than a plate thickness 14At of the rear thick upper plate 14A formed by using a soft steel material (14Bt<14At). As a result, the weight of the upper plate 14 can be reduced as compared with the case in which the upper plate is formed by using only the soft steel material.

Subsequently, indicated at 15 is a lower plate constituting a lower surface of the arm 11. This lower plate 15 is joined to the lower end sides of the left and right side plates 12 and 13 and extends in the front-rear direction. Here, the lower plate 15 is formed by joining two members, that is, a rear thick lower plate 15A located on the rear side of the front-rear direction and a front thin lower plate 15B located on the front side of the front-rear direction.

The rear thick lower plate 15A is formed having a rectangular plate shape extending in the front-rear direction by using a soft steel material having a large plate thickness, that is, a rolled steel material for a general structure such as SS400 and the like, for example. A rear end edge of the rear thick lower plate 15A becomes a boom connecting boss abutting portion 15A1, and the boom connecting boss abutting portion 15A1 is joined to the boom connecting boss 17 which will be described later. A front end edge of the rear thick lower plate 15A becomes a front thin lower plate abutting portion 15A2, and the front thin lower plate abutting portion 15A2 is joined to the front thin lower plate 15B.

On the other hand, the front thin lower plate 15B is formed having a rectangular plate shape extending in the front-rear direction by using a high tensile steel material having a plate thickness smaller than the rear thick lower plate 15A, that is, a high tensile steel material such as SM570 and the like, for example. A rear end edge of the front thin lower plate 15B becomes a rear thick lower plate abutting portion 15B1, and a front end edge of the front thin lower plate 15B becomes a bucket connecting boss abutting portion 15B2. The bucket connecting boss 20 which will be described later is joined to this bucket connecting boss abutting portion 15B2.

In a state in which the front thin lower plate abutting portion 15A2 of the rear thick lower plate 15A and the rear thick lower plate abutting portion 15B1 of the front thin lower plate 15B abut against each other, both-side welding is applied from both surfaces of outer surfaces and inner surfaces of the front thin lower plate abutting portion 15A2 and the rear thick lower plate abutting portion 15B1. As a result, the lower plate 15 in which two members, that is, the rear thick lower plate 15A and the front thin lower plate 15B are firmly joined by a both-side welding bead 15C without a non-welded part is formed.

In this case, as shown in FIG. 5, a plate thickness 15Bt of the front thin lower plate 15B formed by using a high tensile steel material is set smaller than a plate thickness 15At of the rear thick lower plate 15A formed by using a soft steel material (15Bt<15At). As a result, the weight of the lower plate 15 can be reduced as compared with the case in which the lower plate is formed by using only the soft steel material.

Subsequently, indicated at 16 is a rear plate constituting a rear surface of the arm 11. This rear plate 16 is formed having a rectangular plate shape by using a soft steel material having a large plate thickness, that is, a rolled steel material for a general structure such as SS400 and the like, for example, and has a center part in the length direction bent having a mountain shape. Here, the rear plate 16 is joined to the rear end sides between the left and right side plates 12 and 13 and the upper plate 14 by welding and closes a rear end portion of the hollow arm 11.

In this case, the rear plate 16 is joined to the rear plate abutting portion 12A3 of the left rear thick side plate 12A constituting the left side plate 12, the rear plate abutting portion 13A3 of the right rear thick side plate 13A constituting the right side plate 13, and the rear plate abutting portion 14A1 of the rear thick upper plate 14A constituting the upper plate 14 by welding. The front end edge of the rear plate 16 becomes a boom connecting boss abutting portion 16A, and the boom connecting boss abutting portion 16A is joined to the boom connecting boss 17 which will be described later. On the other hand, the arm cylinder bracket 22 which will be described later is fixed to the outer surface of the rear plate 16.

Subsequently, indicated at 17 is a boom connecting boss provided on the rear parts on the lower sides of the left and right side plates 12 and 13. A connecting pin 5E rotabaly connecting the boom 5 and the arm 11 shown in FIG. 1 is inserted into this boom connecting boss 17. Here, the boom connecting boss 17 is composed of a hollow cylindrical boss part 17A extending in the left-right direction and left and right flange parts 17B made of arc-shaped flat plates provided on both end sides in the left-right direction of the cylindrical boss part 17A.

The cylindrical boss part 17A of the boom connecting boss 17 is joined to the boom connecting boss abutting portion 15A1 of the rear thick lower plate 15A constituting the lower plate 15 and the boom connecting boss abutting portion 16A of the rear plate 16 by welding. On the other hand, the left and right flange parts 17B of the boom connecting boss 17 are joined to the boss fitting groove 12A5 of the left rear thick side plate 12A constituting the left side plate 12 and the boss fitting groove 13A5 of the right rear thick side plate 13A constituting the right side plate 13 by welding, respectively.

Figure 7:
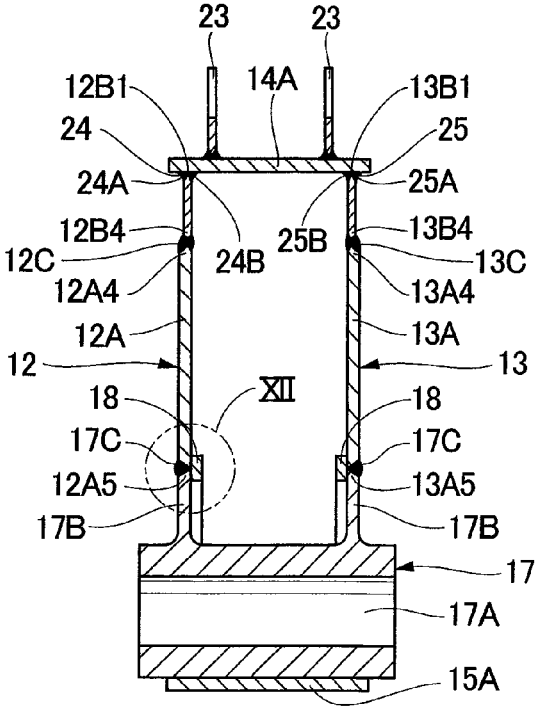
FIG. 7 is a sectional view of the left and right side plates, the rear thick upper plate, the boom connecting boss and the like when seen from an arrow VII-VII direction in FIG. 5.

Indicated at 18 is a pair of left and right backing materials provided on inner surfaces of the left and right rear thick side plates 12A and 13A and the left and right flange parts 17B of the boom connecting boss 17. Each of backing materials 18 is made of a band-shaped steel plate material curved having an arc shape and is arranged along a boundary portion between the boss fitting groove 12A5 of the left rear thick side plate 12A and the left flange part 17B of the boom connecting boss 17 and also arranged along a boundary portion between the boss fitting groove 13A5 of the right rear thick side plate 13A and the right flange part 17B of the boom connecting boss 17 respectively. Between the left rear thick side plate 12A and the left flange part 17B of the boom connecting boss 17, one-side welding is applied from the outer surfaces in a state in which the backing material 18 is made to abut to the inner surfaces. On the other hand, between the right rear thick side plate 13A and the right flange part 17B of the boom connecting boss 17, one-side welding is applied from the outer surfaces in a state in which the backing material 18 is made to abut to the inner surfaces. As a result, as shown in FIG. 7, the left and right rear thick side plates 12A and 13A and the left and right flange parts 17B of the boom connecting boss 17 are firmly joined to each other by a one-side welding bead 17C.

Indicated at 19 is an internal partition wall provided between the inner surface of the rear thick upper plate 14A of the upper plate 14 and the boom connecting boss 17. This internal partition wall 19 is arranged so as to form two closed spaces in the arm 11 and improves rigidity of the arm 11. This internal partition wall 19 is formed of a rectangular flat plate having a width dimension in the left-right direction substantially equal to an interval between the left and right side plates 12 and 13. An upper end portion of the internal partition wall 19 is joined to the rear thick upper plate 14A by welding, and a lower end portion of the internal partition wall 19 is joined to the cylindrical boss parts 17A of the boom connecting boss 17 by welding, respectively.

Subsequently, indicated at 20 is a bucket connecting boss provided on the front end parts of the left and right side plates 12 and 13, the upper plate 14 and the lower plate 15. As shown in FIG. 1, a connecting pin rotatably connecting the bucket 6 and the arm 11 is inserted into this bucket connecting boss 20. Here, the bucket connecting boss 20 is composed of a hollow cylindrical boss part 20A and left and right collar parts 20B each having a flat plate shape provided on the both end sides of the cylindrical boss part 20A. The cylindrical boss part 20A of the bucket connecting boss 20 is joined to the bucket connecting boss abutting portion 14B2 of the front thin upper plate 14B and the bucket connecting boss abutting portion 15B2 of the front thin lower plate 15B by welding. On the other hand, the left side collar part 20B is joined to the bucket connecting boss abutting portion 12B3 of the left front thin side plate 12B by welding, and the right side collar part 20B is joined to the bucket connecting boss abutting portion 13B3 of the right front thin side plate 13B by welding.

Indicated at 21 is the link connecting boss provided on the front end sides of the left and right side plates 12 and 13 adjacent to the rear side of the bucket connecting boss 20. As shown in FIG. 1, a connecting pin connecting the bucket link 7 and the arm 11 is inserted into this link connecting boss 21. Here, the link connecting boss 21 is composed of a hollow cylindrical boss part 21A and left and right flange parts 21B provided on the both end sides of the cylindrical boss part 21A. The left side flange part 21B of the link connecting boss 21 is joined to the boss fitting hole 12B5 of the left front thin side plate 12B by welding, and the right side flange part 21B of the link connecting boss 21 is joined to the boss fitting hole 13B5 of the right front thin side plate 13B by welding.

Subsequently, indicated at 22 is a pair of left and right arm cylinder brackets provided on the outer surface of the rear plate 16. To each of these arm cylinder brackets 22, a rod tip end of the arm cylinder 9 shown in FIG. 1 is rotatably connected through a connecting pin. Here, each of the arm cylinder brackets 22 is formed as a substantially triangular plate member, and a pin insertion hole 22A is drilled on its distal end side. The arm cylinder brackets 22 are joined to the outer surface of the rear plate 16 by welding in a state keeping a constant interval in the left-right direction.

Indicated at 23 is a pair of left and right bucket cylinder brackets provided on the outer surface on the rear end side of the upper plate 14. To each of these bucket cylinder brackets 23, a bottom side of the bucket cylinder 10 shown in FIG. 1 is rotatably connected through a connecting pin. Here, each of the bucket cylinder brackets 23 is formed as a substantially triangular plate member by using a plate material such as a steel plate material or the like, and a pin insertion hole 23A is drilled on its distal end side. The bucket cylinder brackets 23 are joined to the outer surface of the rear thick upper plate 14A by welding in a state keeping a constant interval in the left-right direction.

The arm 11 according to this embodiment has the above described configuration, and subsequently, an example of a procedure for manufacturing the arm 11 will be described.

Figure 8:
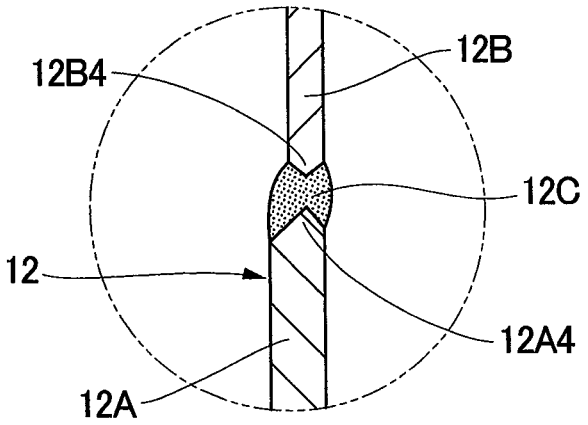
FIG. 8 is an enlarged view of a VIII part in FIG. 6 showing a joint part between the left rear thick side plate and the left front thin side plate.

In a state in which the front thin side plate abutting portion 12A4 of the left rear thick side plate 12A and the rear thick side plate abutting portion 12B4 of the left front thin side plate 12B abut against each other, both-side welding is applied between the both from both surfaces of outer surfaces and inner surfaces. As a result, as shown in FIGS. 6 to 8, the both-side welding bead 12C without a non-welded part can be formed between the front thin side plate abutting portion 12A4 of the left rear thick side plate 12A and the rear thick side plate abutting portion 12B4 of the left front thin side plate 12B. As a result, the left side plate 12 in which two members, that is, the left rear thick side plate 12A and the left front thin side plate 12B are firmly joined can be formed.

On the other hand, in a state in which the front thin side plate abutting portion 13A4 of the right rear thick side plate 13A and the rear thick side plate abutting portion 13B4 of the right front thin side plate 13B abut against each other, both-side welding is applied between the both from both surfaces of outer surfaces and inner surfaces. As a result, the both-side welding bead 13C without a non-welded part can be formed between the front thin side plate abutting portion 13A4 of the right rear thick side plate 13A and the rear thick side plate abutting portion 13B4 of the right front thin side plate 13B. As a result, the right side plate 13 in which two members, that is, the right rear thick side plate 13A and the right front thin side plate 13B are firmly joined can be formed.

Subsequently, each of the left and right flange parts 17B of the boom connecting boss 17 is joined to the boss fitting groove 12A5 provided on the left rear thick side plate 12A of the left side plate 12 and the boss fitting groove 13A5 provided on the right rear thick side plate 13A of the right side plate 13 by welding, respectively. In this case, each of the backing materials 18 is fixed to the inner surface of each of the flange parts 17B in advance respectively, and the backing materials 18 protruding from outer peripheral edge portions of the flange parts 17B are brought into contact with the inner surfaces of the left and right rear thick side plates 12A and 13A. In this state, one-side welding is applied between the left rear thick side plate 12A and the flange part 17B from the outer surface of the left rear thick side plate 12A. On the other hand, one-side welding is applied between the right rear thick side plate 13A and the flange part 17B from the outer surface of the right rear thick side plate 13A. As a result, the left and right rear thick side plates 12A and 13A and the left and right flange parts 17B of the boom connecting boss 17 can be firmly joined through the one-side welding bead 17C. In this case, a work of welding the left and right flange parts 17B of the boom connecting boss 17 to the left and right rear thick side plates 12A and 13A can be performed from the outer surfaces of the left and right rear thick side plates 12A and 13A, whereby its workability can be improved.

Subsequently, each of the left and right flange parts 21B of the link connecting boss 21 is joined to the boss fitting hole 12B5 provided on the left front thin side plate 12B of the left side plate 12 and the boss fitting hole 13B5 provided on the right front thin side plate 13B of the right side plate 13 by welding, respectively. Moreover, each of the left and right collar parts 20B of the bucket connecting boss 20 is joined to the bucket connecting boss abutting portion 12B3 provided on the left front thin side plate 12B of the left side plate 12 and the bucket connecting boss abutting portion 13B3 provided on the right front thin side plate 13B of the right side plate 13 by welding, respectively.

Figure 9:
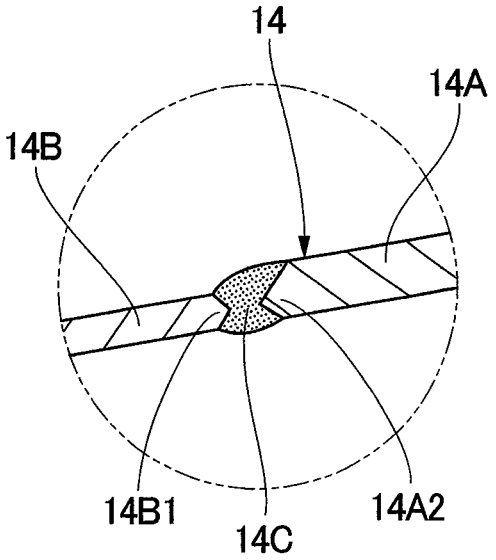
FIG. 9 is an enlarged view of a IX part in FIG. 5 showing a joint part between the rear thick upper plate and the front thin upper plate.

On the other hand, in a state in which the front thin upper plate abutting portion 14A2 of the rear thick upper plate 14A and the rear thick upper plate abutting portion 14B1 of the front thin upper plate 14B abut against each other, both-side welding is applied between the both from both surfaces of outer surfaces and inner surfaces. As a result, as shown in FIGS. 5 and 9, the both-side welding bead 14C without a non-welded part can be formed between the front thin upper plate abutting portion 14A2 of the rear thick upper plate 14A and the rear thick upper plate abutting portion 14E1 of the front thin upper plate 14B. As a result, the upper plate 14 in which two members, that is, the rear thick upper plate 14A and the front thin upper plate 14B are firmly joined can be formed.

Moreover, in a state in which the front thin lower plate abutting portion 15A2 of the rear thick lower plate 15A and the rear thick lower plate abutting portion 15B1 of the front thin lower plate 15B abut against each other, both-side welding is applied between the both from both surfaces of outer surfaces and inner surfaces. As a result, as shown in FIG. 5, the both-side welding bead 15C without a non-welded part can be formed between the front thin lower plate abutting portion 15A2 of the rear thick lower plate 15A and the rear thick lower plate abutting portion 15B1 of the front thin lower plate 15B. As a result, the lower plate 15 in which two members, that is, the rear thick lower plate 15A and the front thin lower plate 15B are firmly joined can be formed.

Subsequently, in a state in which the upper plate 14 is arranged on the upper end sides of the left side plate 12 and the right side plate 13, fillet welding is applied between the upper plate abutting portion 12A1 of the left rear thick side plate 12A constituting the left side plate 12 and the rear thick upper plate 14A of the upper plate 14 from both surfaces of outer surfaces and inner surfaces thereof. On the other hand, fillet welding is applied between the upper plate abutting portion 12B1 of the left front thin side plate 12B and the rear thick upper plate 14A and the front thin upper plate 14B of the upper plate 14 from both surfaces of outer surfaces and inner surfaces thereof. Similarly to this, fillet welding is applied between the upper plate abutting portion 13A1 of the right rear thick side plate 13A constituting the right side plate 13 and the rear thick upper plate 14A of the upper plate 14 from both surfaces of outer surfaces and inner surfaces thereof. On the other hand, fillet welding is applied between the upper plate abutting portion 13B1 of the right front thin side plate 13B and the rear thick upper plate 14A and the front thin upper plate 14B of the upper plate 14 from both surfaces of outer surfaces and inner surfaces thereof.

Figure 10:
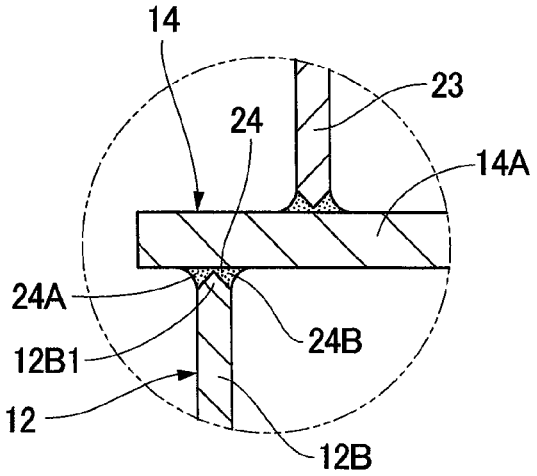
FIG. 10 is an enlarged view of a X part in FIG. 6 showing a joint part between the left front thin side plate and the rear thick upper plate.

As a result, as shown in FIGS. 6 and 10, a welding bead 24 without a non-welded part in which an outer bead part 24A formed from the outer side of the left side plate 12 and an inner bead part 24B formed from the inner side of the left side plate 12 are melted and integrated can be formed at the corner part where the left side plate 12 and the upper plate 14 intersect each other. Similarly to this, as shown in FIG. 6, a welding bead 25 without a non-welded part in which an outer bead part 25A formed from the outer side of right side plate 13 and an inner bead part 25B formed from the inner side of the right side plate 13 are melted and integrated can be formed at the corner part where the right side plate 13 and the upper plate 14 intersect each other.

Figure 4:
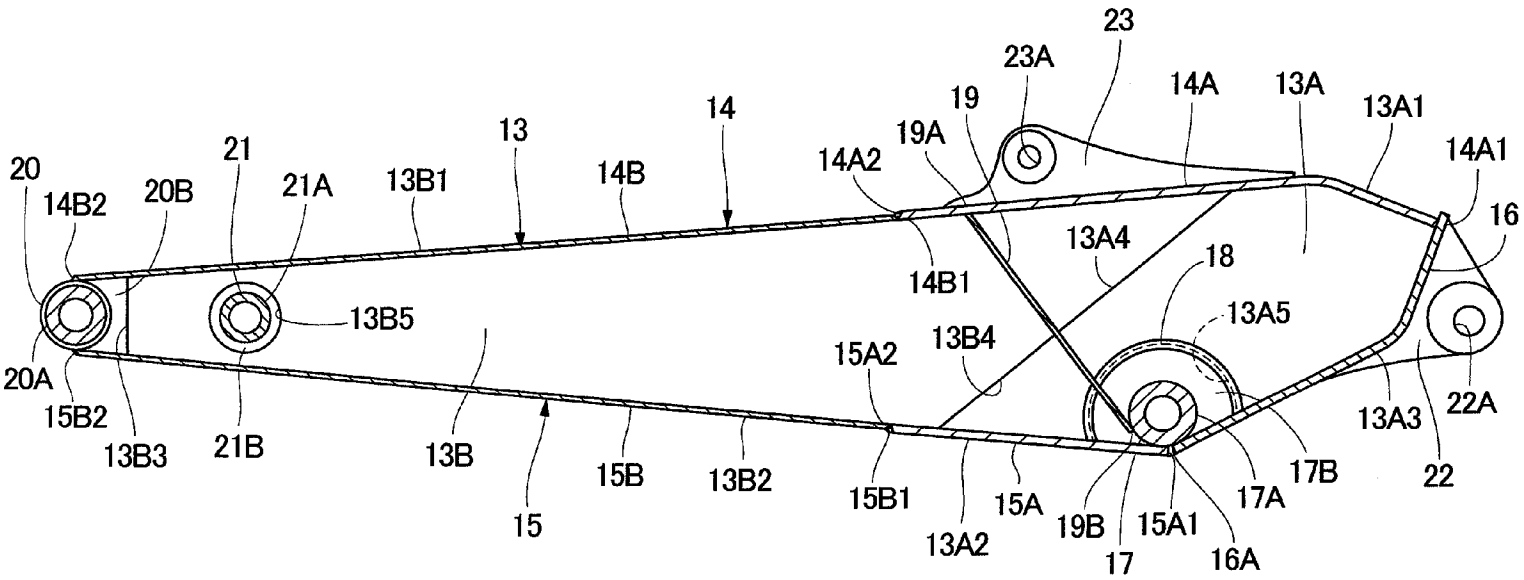
FIG. 4 is a sectional view of the arm when seen from an arrow IV-IV direction in FIG. 2.

Subsequently, as shown in FIGS. 4 and 5, an upper end portion 19A of the internal partition wall 19 is welded to a front part position of the rear thick upper plate 14A constituting the upper plate 14, and a lower end portion 19B of the internal partition wall 19 is welded to the cylindrical boss part 17A of the boom connecting boss 17. On the other hand, as shown in FIG. 6, left and right side end portions 19C of the internal partition wall 19 are welded to the inner surface of the left side plate 12 and the inner surface of the right side plate 13, respectively.

Subsequently, in a state in which the lower plate 15 is arranged on the lower end sides of the left side plate 12 and the right side plate 13, fillet welding is applied between the lower plate abutting portion 12A2 of the left rear thick side plate 12A and the rear thick lower plate 15A of the lower plate 15 from the outer surfaces thereof, and fillet welding is applied between the lower plate abutting portion 12B2 of the left front thin side plate 12B and the rear thick lower plate 15A and the front thin lower plate 15B of the lower plate 15 from the outer surfaces thereof. On the other hand, fillet welding is applied between the lower plate abutting portion 13A2 of the right rear thick side plate 13A and the rear thick lower plate 15A of the lower plate 15 from the outer surfaces thereof, and fillet welding is applied between the lower plate abutting portion 13B2 of the right front thin side plate 13B and the rear thick lower plate 15A and the front thin lower plate 15B of the lower plate 15 from the outer surfaces thereof.

Figure 11:
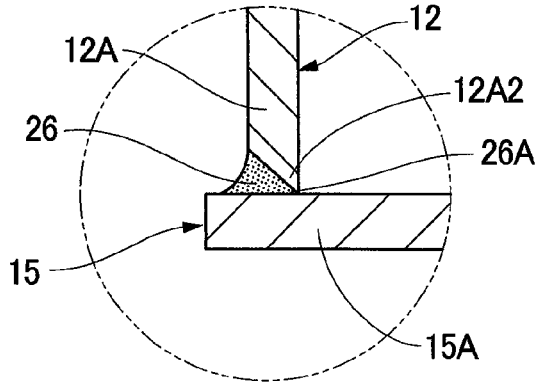
FIG. 11 is an enlarged view of a XI part in FIG. 6 showing a joint part between the left rear thick side plate and the rear thick lower plate.
Figure 12:
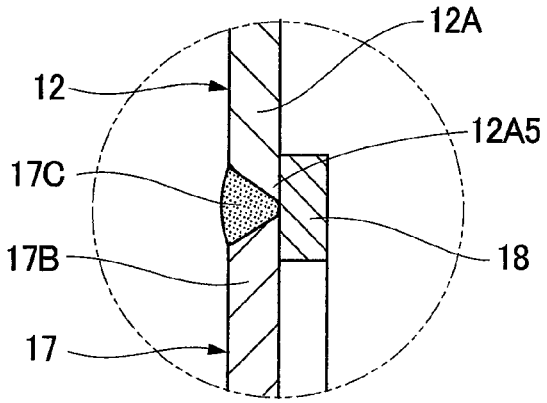
FIG. 12 is an enlarged view of a XII part in FIG. 7 showing a joint part between the left rear thick side plate and the boom connecting boss.

As a result, as shown in FIGS. 6 and 11, a welding bead 26 can be formed on the corner part where the left side plate 12 and the lower plate 15 intersect each other from the outer side of the left side plate 12. Moreover, a welding bead 27 can be formed on the corner part where the right side plate 13 and the lower plate 15 intersect each other from the outer side of the right side plate 13. In this case, when the lower plate 15 is to be joined to the left and right side plates 12 and 13, a closed space surrounded by the left and right side plates 12 and 13, the upper plate 14, and the lower plate 15 is covered by a lid by the lower plate 15. Thus, a welding bead cannot be formed on the corner part where the left side plate 12 and the lower plate 15 intersect each other from the inner side of the left side plate 12, and a welding bead cannot be formed on the corner part where the right side plate 13 and the lower plate 15 intersect each other from the inner side of the right side plate 13.

Therefore, as shown in FIGS. 6 and 11, the welding bead 26 formed on the corner part where the left side plate 12 and the lower plate 15 intersect each other might include a non-welded part 26A on the inner surface of the left side plate 12. Moreover, as shown in FIG. 6, the welding bead 27 formed on the corner part where the right side plate 13 and the lower plate 15 intersect each other might include a non-welded part 27A on the inner surface of the right side plate 13.

Subsequently, after the upper plate 14 is joined to the upper end sides of the left and right side plates 12 and 13 and the lower plate 15 is joined to the lower end sides, fillet welding is applied between the rear plate abutting portion 12A3 of the left rear thick side plate 12A and the rear plate 16, and fillet welding is applied between the rear plate abutting portion 13A3 of the right rear thick side plate 13A and the rear plate 16. On the other hand, fillet welding is applied between the rear plate abutting portion 14A1 of the rear thick upper plate 14A constituting the upper plate 14 and the rear plate 16, and the boom connecting boss abutting portion 16A of the rear plate 16 is welded to the cylindrical boss part 17A of the boom connecting boss 17.

Subsequently, the pair of left and right arm cylinder brackets 22 are joined to the outer surface of the rear plate 16 by welding, and the pair of left and right bucket cylinder brackets 23 are joined to the outer surface of the rear thick upper plate 14A constituting the upper plate 14 by welding.

As described above, by welding the left side plate 12, the right side plate 13, the upper plate 14, the lower plate 15, and the rear plate 16 to each other, the arm 11 having the box-shaped structural body forming a closed sectional structure having a square cross section can be formed.

Here, the arm 11 according to this embodiment forms the left rear thick side plate 12A constituting the left side plate 12, the right rear thick side plate 13A constituting the right side plate 13, the rear thick upper plate 14A constituting the upper plate 14, and the rear thick lower plate 15A constituting the lower plate 15 by using a soft steel material having a large plate thickness, respectively. On the other hand, the left front thin side plate 12B, the right front thin side plate 13B, the front thin upper plate 14B, and the front thin lower plate 15B are formed by using the high tensile steel material having a small plate thickness, respectively. As a result, the weight of the entire arm 11 can be reduced as compared with the case in which the arm is formed by using the upper plate, the lower plate, the left side plate, and the right side plate made of a single soft steel material, for example.

On the other hand, according to the arm 11 of this embodiment, the boom connecting boss 17 into which the connecting pin 5E connecting the boom 5 and the arm 11 to each other is inserted can be joined to the left rear thick side plate 12A, the right rear thick side plate 13A, the rear thick lower plate 15A, and the rear plate 16 made of a soft steel material. Moreover, the rear plate to which the arm cylinder bracket 22 is to be joined can be joined to the left rear thick side plate 12A, the right rear thick side plate 13A, and the rear thick upper plate 14A made of a soft steel material.

Thus, when en external force acts on the arm 11 through the boom connecting boss 17 and the arm cylinder bracket 22, the left rear thick side plate 12A, the right rear thick side plate 13A, the rear thick upper plate 14A, the rear thick lower plate 15A, and the rear plate 16 made of a soft steel material can generate appropriate deflection in accordance with the external force.

As a result, as shown in FIG. 6, even if the non-welded part 26A is formed on the inner side of the corner part where the left rear thick side plate 12A and the rear thick lower plate 15A intersect each other and the non-welded part 27A is formed on the inner side of the corner part where the right rear thick side plate 13A and the rear thick lower plate 15A intersect each other, for example, concentration of stress on the non-welded parts 26A and 27A can be suppressed, and fatigue strength of the arm 11 can be improved. As a result, according to this embodiment, weight reduction of the arm 11 and improvement of fatigue strength of the arm 11 can be both realized, and reliability of the entire arm 11 can be improved.

Moreover, in the arm 11 according to this embodiment, between the left rear thick side plate 12A and the left front thin side plate 12B, between the right rear thick side plate 13A and the right front thin side plate 13B, between the rear thick upper plate 14A and the front thin upper plate 14B, and between the rear thick lower plate 15A and the front thin lower plate 15B are joined by both-side welding from both surfaces of the outer surfaces and the inner surfaces, respectively.

As a result, the left side plate 12 in which the left rear thick side plate 12A and the left front thin side plate 12B are joined by the both-side welding bead 12C can be formed. The right side plate 13 in which the right rear thick side plate 13A and the right front thin side plate 13B are joined by the both-side welding bead 13C can be formed. On the other hand, the upper plate 14 in which the rear thick upper plate 14A and the front thin upper plate 14B are joined by the both-side welding bead 14C can be formed. Moreover, the lower plate 15 in which the rear thick lower plate 15A and the front thin lower plate 15B are joined by the both-side welding bead 15C can be formed. As a result, strength of the entire arm 11 formed of the box-shaped structural body surrounded by the left side plate 12, the right side plate 13, the upper plate 14, the lower plate 15, and the rear plate 16 can be further improved.

It should be noted that in the above described embodiment, as an example of a procedure for assembling the arm 11, after the boom connecting boss 17, the bucket connecting boss 20, and the link connecting boss 21 are joined to the left and right side plates 12 and 13, the upper plate 14 is joined to each of the side plates 12 and 13. Subsequently, the case in which, after the internal partition wall 19 is joined between the upper plate 14 and the boom connecting boss 17, the lower plate 15 and the rear plate 16 are joined to each of the side plates 12 and 13 is exemplified. However, the assembling procedure of the arm 11 according to the present invention is not limited to that, and the procedure for assembling the arm 11 can be changed as appropriate.

Moreover, in the above described embodiment, the crawler type hydraulic excavator 1 is explained as an example of a construction machine, but the present invention is not limited to that and can be widely applied to arms of other construction machines such as an arm used in a wheel type hydraulic excavator, for example.

DESCRIPTION OF REFERENCE NUMERALS

1: Hydraulic excavator (Construction machine)
11: Arm
12: Left side plate
12A: Left rear thick side plate
12B: Left front thin side plate
12C, 13C, 14C, 15C: Both-side welding bead
13: Right side plate
13A: Right rear thick side plate
13B: Right front thin side plate
14: Upper plate
14A: Rear thick upper plate
14B: Front thin upper plate
15: Lower plate
15A: Rear thick lower plate
15B: Front thin lower plate
16: Rear plate
17: Boom connecting boss
17A: Cylindrical boss part
17B: Flange part
17C: One-side welding bead
18: Backing material
20: Bucket connecting boss
21: Link connecting boss
22: Arm cylinder bracket
23: Bucket cylinder bracket
24, 25, 26, 27: Welding bead
24A, 25A: Outer bead
24B, 25B: Inner bead

The invention claimed is:

1. An arm for a construction machine formed as a box-shaped structural body having a square cross section by a left side plate, a right side plate, an upper plate joined to upper end sides of said left and right side plates by welding, a lower plate joined to lower end sides of said left and right side plates by welding, and a rear plate joined to rear end sides of said left and right side plates and a rear end side of said upper plate by welding, in which a boom connecting boss located on rear part lower sides of said left and right side plates and joined to rear ends of said left and right side plates and said lower plate and a front end of said rear plate by welding is provided, and a pair of left and right arm cylinder brackets joined to an outer surface of said rear plate by welding are provided, characterized in that:

said left side plate is formed by joining two members, that is, a left rear thick side plate located on a rear side where said boom connecting boss is joined and made of a soft steel material with a large plate thickness and a left front thin side plate located on a front side of said left rear thick side plate and made of a high tensile steel material with a small plate thickness;

said right side plate is formed by joining two members, that is, a right rear thick side plate located on the rear side where said boom connecting boss is joined and made of a soft steel material with a large plate thickness and a right front thin side plate located on the front side of said right rear thick side plate and made of a high tensile steel material with a small plate thickness;

said upper plate is formed by joining two members, that is, a rear thick upper plate located on the rear side where said rear plate is joined and made of a soft steel material having a large plate thickness and a front thin upper plate located on the front side of said rear thick upper plate and made of a high tensile steel material having a small plate thickness;

said lower plate is formed by joining two members, that is, a rear thick lower plate located on the rear side where said boom connecting boss is joined and made of a soft steel material having a large plate thickness and a front thin lower plate located on the front side of said rear thick lower plate and made of a high tensile steel material having a small plate thickness; and said rear plate is formed by using a soft steel material having a large plate thickness.

2. The arm for a construction machine according to claim 1, wherein said left rear thick side plate and said left front thin side plate are joined by a both-side welding bead formed by both-side welding from both surfaces of an outer surface and an inner surface;

said right rear thick side plate and said right front thin side plate are joined by a both-side welding bead formed by both-side welding from both surfaces of the outer surface and the inner surface, said rear thick upper plate and said front thin upper plate are joined by a both-side welding bead formed by both-side welding from both surfaces of the outer surface and the inner surface; and said rear thick lower plate and said front thin lower plate are joined by a both-side welding bead formed by both-side welding from both surfaces of the outer surface and the inner surface.

3. The arm for a construction machine according to claim 2, wherein said boom connecting boss is composed of a cylindrical boss part penetrating said left and right side plates and extending in a left-right direction and through which a connecting pin for connecting the boom is inserted and left and right flange parts provided on both end sides in the left-right direction of said cylindrical boss part, respectively;

boss fitting grooves fitted with the left and right flange parts of said boom connecting boss are provided on said left and right rear thick side plates, respectively;

backing materials are provided on inner surfaces of said left and right rear thick side plates and the left and right flange parts of said boom connecting boss along a boundary portion between said flange parts and said boss fitting grooves respectively; and said left and right rear thick side plates and the left and right flange parts of said boom connecting boss are joined by a one-side welding bead formed by one-side welding from the outer surface in a state in which said backing materials are brought into contact with the inner surface respectively.

4. The arm for a construction machine according to claim 1, wherein an upper end side of said left side plate composed of said left rear thick side plate and said left front thin side plate and said upper plate composed of said rear thick upper plate and said front thin upper plate are joined by a welding bead in which an outer bead part and an inner bead part formed by fillet welding from both surfaces of outer surfaces and inner surfaces thereof are integrated;

an upper end side of said right side plate composed of said right rear thick side plate and said right front thin side plate and said upper plate composed of said rear thick upper plate and said front thin upper plate are joined by a welding bead in which an outer bead part and an inner bead part formed by fillet welding from both surfaces of outer surfaces and inner surfaces thereof are integrated;

a lower end side of said left side plate composed of said left rear thick side plate and said left front thin side plate and said lower plate composed of said rear thick lower plate and said front thin lower plate are joined by a welding bead formed by fillet welding from the outer surfaces thereof; and a lower end side of said right side plate composed of said right rear thick side plate and said right front thin side plate and said lower plate composed of said rear thick lower plate and said front thin lower plate are joined by a welding bead formed by fillet welding from the outer surfaces thereof.

5. The arm for a construction machine according to claim 1, wherein a bucket connecting boss is joined by welding to distal ends of said left and right front thin side plates constituting said left and right side plates, said front thin upper plate constituting said upper plate and said front thin lower plate constituting said lower plate;

a link connecting boss is joined adjacent to a rear side of said bucket connecting boss by welding to front sides of said left and right front thin side plates constituting said left and right side plates; and a pair of left and right bucket cylinder brackets are joined by welding on the outer surface of said rear thick upper plate constituting said upper plate.

6. The arm for a construction machine according to claim 1, wherein said soft steel material is a low carbon steel material having a carbon content of less than 0.3%, and said high tensile steel material is a steel material having enhanced strength than the soft steel and having tensile strength of 50 $kgf/mm^2$ or more.

7. The arm for a construction machine according to claim 1, wherein said boom connecting boss is composed of a cylindrical boss part penetrating said left and right side plates and extending in a left-right direction and through which a connecting pin for connecting the boom is inserted and left and right flange parts provided on both end sides in the left-right direction of said cylindrical boss part, respectively;

boss fitting grooves fitted with the left and right flange parts of said boom connecting boss are provided on said left and right rear thick side plates, respectively;

backing materials are provided on inner surfaces of said left and right rear thick side plates and the left and right flange parts of said boom connecting boss along a boundary portion between said flange parts and said boss fitting grooves respectively; and said left and right rear thick side plates and the left and right flange parts of said boom connecting boss are joined by a one-side welding bead formed by one-side welding from the outer surface in a state in which said backing materials are brought into contact with the inner surface respectively.

* * * * *